United States Patent [19]

Blommer et al.

[11] Patent Number: 4,768,418

[45] Date of Patent: Sep. 6, 1988

[54] EXPLOSIVE ATTENUATING MISSILE TRANSPORTATION AND STORAGE RACK

[75] Inventors: Eric J. Blommer, Taylorsville; Dennis L. Wheeler, Lindon, both of Utah

[73] Assignee: The United States of America as represented by the Secretary of the Air Force, Washington, D.C.

[21] Appl. No.: 789,794

[22] Filed: Oct. 21, 1985

[51] Int. Cl.[4] ..... B65D 81/08

[52] U.S. Cl. ..... 89/34; 206/3

[58] Field of Search ..... 89/34; 206/3

[56] References Cited

U.S. PATENT DOCUMENTS

| | | | |
|---|---|---|---|
| 3,801,416 | 4/1974 | Gulbierz | 161/36 |
| 4,048,365 | 9/1977 | Hoover | 428/215 |
| 4,079,161 | 3/1978 | Kile | 428/220 |
| 4,248,342 | 2/1981 | King et al. | 89/34 X |
| 4,286,708 | 9/1981 | Porzel | 206/3 |
| 4,316,404 | 2/1982 | Medlin | 89/36 |
| 4,432,285 | 2/1984 | Boyars et al. | 109/49.5 |
| 4,440,296 | 4/1984 | Howe et al. | 89/34 X |
| 4,469,295 | 9/1984 | Schuster | 220/445 X |

OTHER PUBLICATIONS

R. B. Leining, J. F. Wagner, and E. J. Blommer, "Missile Motor Handling", AFRPL TR-84-024, Jun. 1984.

Dr. John S. Rinehart, "Practical Countermeasures for the Prevention of Spallation", AFSWC-TR-60-7, Feb. 1960.

*Primary Examiner*—Ted L. Parr

*Attorney, Agent, or Firm*—Donald J. Singer; Thomas L. Kundert; Fredric L. Sinder

[57] ABSTRACT

A structure for attenuating explosive shock waves to prevent propagation of accidental explosions by sympathetic detonation of adjacent explosives comprising bidirectionally symmetric layers of material of consecutively increasing or decreasing acoustic impedance laminated about a center layer. The structure may be made by combining several materials, as in consecutive layers of aluminum, plastic, and a rigid foam surrounding on both sides a layer of steel; or, two materials, as in a center layer of Kevlar TM surrounded on both faces with layers of plastic. The plies comprising the layer of Kevlar TM are canted with respect to the plastic layers.

6 Claims, 3 Drawing Sheets

EXPLOSIVE ATTENUATING MISSILE TRANSPORTATION AND STORAGE RACK

RIGHTS OF THE GOVERNMENT

The invention described herein may be manufactured and used by or for the Government of the United States for all governmental purposes without the payment of any royalty.

BACKGROUND OF THE INVENTION

This invention relates generally to the field of explosive shock wave attenuators, especially to attenuators designed to be inserted between mass-detonable explosives to prevent the propagation of accidental explosions by sympathetic detonation of adjacent explosives, and more particularly to attenuators suitable for use in the close environment of a logistic missile container, or inside a missile between the warhead and rocket motor.

The use of attenuating materials between mass-detonable explosives such as projectiles, bombs and missile propellants is well known. The goal has been to reduce the risk of an accidental explosion of one explosive from spreading by sympathetic detonation of adjacent explosives. Obtaining this goal reduces the spacing normally required for safe storage of such devices, creating savings in both space and siting costs. Explosives and propellants would be safer to store, transport and handle. A more efficient attenuator will help gain safety acceptance for the use of hazard Class/division 1.1, or min-smoke, rocket motors in place of the less powerful Class 1.3 rocket motors now generally used, and will make existing Class 1.1 warheads safer to handle.

Attenuating material used between mass-detonable explosives is typically sacrificial, in that a substantial portion of the explosive energy to be absorbed by the attenuator is dissipated in crushing or otherwise deforming the attenuating material. Typical sacrificial attenuator materials used in the past are earth, foamed concrete, layered wallboard, or steel I-beams. These materials are thick and heavy and are unsuitable for use in close environments such as logistical containers for the storage of missiles, or inside the missiles to separate the explosives contained in the warheads from the explosive propellants contained in the rocket motors. Thinner, and also lighter, attenuators are needed.

One proposed solution to the need for a better attenuator for this use has been perforated plates, a thinner variation of typically bulky baffled-venting methods. The perforated plates attenuate by the rapid dissipation of the energy required to force jets of air or other gases through the openings in the plates. Although relatively light in weight, the perforated plates have had problems of projecting secondary fragments in an explosion. Pairs of perforated plates have been tested with apparently better results and would be suitable where wider spacing between missiles is avallable.

Another proposed solution has been the use of sacrificial rigid foams such as scoria, a foamed glass of volcanic origin. These rigid foams, when shaped to meet the requirements of typical logistical missile containers, will not survive the rough handling and other requirements of those containers.

The use of laminates to attenuate the propagation of projectiles, shock vibration from explosions, and the shrapnel that often accompanies explosions, is well established. Laminates are made generally either to combine the desired properties of two or more materials, or to take advantage of the consecutive reflections of the shock wave that takes place at the interfaces between the materials forming the laminations. These consecutive reflections increase the time and distance for the entire energy of an incident shock wave to pass through the material, both spreading out the wavefront, and increasing the attenuation through conversion to heat from internal friction. The resistance of a material to the transmission of vibration is termed acoustic impedance. Most of the laminates used to date have consisted of laminations of material of alternating acoustic impedances, while the literature has recommended the use of laminations of successively reduced acoustic impedances to take advantage of the increased attenuation of the peak stress of a vibration wavefront that occurs when vibration crosses consecutive interfaces from materials of higher to lower acoustic impedance.

Polyaramid filaments, such as Kevlar TM, when mixed with a resin to form sheets or plies have seen increasing use as an attenuator material, especially against the propagation of projectiles.

Despite the variety of approaches which have been tried in the past, the prior art does not disclose an optimum combination of attenuator material and design for use between mass-detonable explosives, particularly a design specifically suitable for the close environments found in missile storage containers and inside missiles, and where transportation by air requires minimizing dead weight.

With the foregoing in mind, it is, therefore, a principal object of the present invention to provide an improved attenuator suitable for use between explosives where the direction from which the initial accidential explosion will occur is unknown, and which incorporates protection against sympathetic detonation in a more efficient, and thus thinner and lighter, structure.

SUMMARY OF THE INVENTION

In accordance with the foregoing principles and objects of the present invention, a novel explosive attenuator is described which is particularly suitable for use between mass-detonable explosives, and for the close environments found in missile storage containers and inside missiles.

The invention utilizes a bidirectionally laminated design which allows the initial accidental explosion to occur on either side of the structure with equal attenuation. Two laminates are described. The first laminate is symmetrically laminated about a center layer with layers of consecutively increasing or decreasing (monotonically graduated) acoustic impedance. The first laminate may include a layer of rigid foam to provide for additional attenuation through crushing. The second laminate utilizes plies of Kevlar TM to form a sheet which is surrounded on both its faces with sheets of plastic.

The invention additionally includes structures for the use of the new attenuators in missile storage racks and inside missiles.

BRIEF DESCRIPTION OF THE DRAWINGS

The present invention will be more clearly understood from a reading of the following detailed description in conjunction with the accompanying drawings.

DETAILED DESCRIPTION OF THE INVENTION

Figure 1:
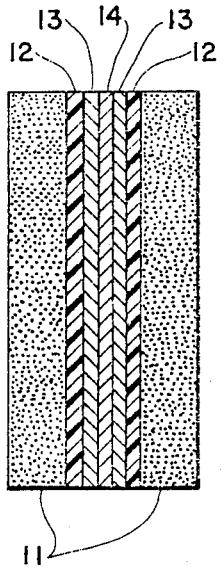
FIG. 1 is a cross-sectional view of a bidirectional laminate structure with layers of descending-ascending acoustic impedance.

Referring now to FIG. 1 of the drawings, there is shown a cross-sectional view of a representative embodiment of the invention. The embodiment depicted comprises a center sheet 14 of steel, bidirectionally surrounded in order by sheets of material of successively increasing acoustic impedance, being aluminum 13, polymethyl methacrylate (PMMA) acrylic plastic 12, and a rigid foam 11 made from a 50/50 mixture of glass microballoons and a polyurethane resin. The hollow glass microballoons provide for high volume and low weight with good energy absorption through crushing, and their mixture with an epoxy resin is a good synthetic substitute for naturally occuring scoria. The other sheets provide, in addition to their shock attenuation properties, structural support for the rigid foam. The sheets are bonded together with epoxy adhesive. The total thickness of the laminate structure is about one inch, with the steel, aluminum and PMMA sheets each approximately 0.0625 inches, and the rigid foam sheets each approximately 0.344 inches thick. The thickness of the entire laminate may be scaled up to provide the desired degree of protection in a given container within existing physical contraints on space or weight.

The acoustic impedance or resistance of a material is the product of its density and its acoustic velocity. The acoustic velocity is how fast transient stresses will travel through the material. The distribution of stresses at an interface between a first and a second material is expressed by two fundamental equations.

$$\sigma_T = \frac{2\rho_2 c_2}{\rho_2 c_2 + \rho_1 c_1}\,\sigma_I$$

$$\sigma_R = \frac{\rho_2 c_2 - \rho_1 c_1}{\rho_2 c_2 + \rho_1 c_1}\,\sigma_I$$

where $\sigma$ represents stress, $\sigma_I$ represents the incident stress at the interface, $\sigma_T$ represents the stress transmitted into the second material, and $\sigma_R$ represents the stress reflected back into the first material. Positive values of $\sigma$ represent a compression stress, and negative values a tension stress. $\rho_1$ and $\rho_2$ represent the densities of the two materials, and $c_1$ and $c_2$ represent the two acoustic velocities.

When these two equations are solved for the case of a compression stress traveling from a first material of low acoustic impedance to a second material of much higher acoustic impedance (generally more rigid), the transmitted stress is increased to approximately twice that of the stress of the incident wave. The equations can also be solved to show that the transmitted stress of a compression wave from a first material of higher acoustic impedance to a second material of lower acoustic impedance is less than that of the incident stress. By passing the incident compression stress through a series of interfaces between materials of decreasing acoustic impedance, the transmitted stress is significantly reduced. Even in materials where the successive internally reflected stresses suffer only small losses as they pass through the materials and interfaces and eventually are transmitted to the last material, the spreading out of the wavefront in time produces a significant reduction in the maximum transmitted stress.

It should be noted that explosions produce shock waves of intensity and effect greater than what can be accounted for merely by replacing in the fundamental equations a variable which may be termed shock velocity in place of acoustic velocity. And, the density of the materials may change during explosively rapid changes in heat and pressure. However, the fundamental property that transmitted stress is attenuated or reduced by transmission through materials of successively decreasing acoustic-impedance experimentally remains valid.

Returning again to the laminate shown in FIG. 1, it is seen that an accidental explosion of a missile warhead or other explosive or propellant on either side of the laminate will cause an impact of a shock wave and accompanying shrapnel-like missile fragments first against the rigid foam, where energy is dissipated through crushing. The remaining transmitted stress will be increased as the wave passes through interfaces between materials of successively higher acoustic impedance; but, consecutive solutions of the equations show that the attenuation in passing through the sheets of successively lower acoustic impedance on the opposite side of the center sheet produce a greater reduction in stress than the previous increase. The attenuation sheet must be bidirectionally symmetrical about its center layer as shown because the direction from which the first accidental explosion will come is unknown.

The laminate shown in FIG. 1 may be alternately constructed with the rigid foam as the center layer, bidirectionally surrounded in order by sheets of material of symmetrically decreasing acoustic impedance, being PMMA acrylic plastic, aluminum, and, finally, steel as the outer layer. Consecutive solutions of the two equations indicate that this configuration should work just as well as that shown in FIG 1, but card-gap tests, as explained below, have shown that the embodiment shown in FIG. 1 provides greater attenuation for equal thickness and weight. In addition, placing the steel layer in the center reduces the possibility of creating additional steel shrapnel. Additional card gap tests indicate that it may be possible to eliminate the steel layer entirely with little or no effect on the total attenuation. In addition, it will be seen by those skilled in the art that the rigid foam may be made from plastic rather than glass microballoons, and with other resins and percentages of microballoons to resin, with equal effect in a search for a more effective attenuator. Similarly, other materials may be substituted for the other sheets, as long as the pattern of consecutively increasing and decreasing acoustic impedance is maintained.

The standard test for measuring the attenuation properties of material is a card-gap test, where standard explosive charges are arranged on either side of a gap. Layers of standard plastic cards are placed in the gap until a thickness is reached that prevents the explosion of one standard explosive from sympathetically causing the explosion of the standard explosive on the other side of the gap. The increased efficiency of an attenuator over the standard plastic cards will be shown if a thinner section of attenuator prevents sympathetic detonation of the opposite explosive. The card-gap test may be modified to provide for shrapnel and other elements of an actual accidental explosion of a missile warhead or rocket motor.

Figure 2B:
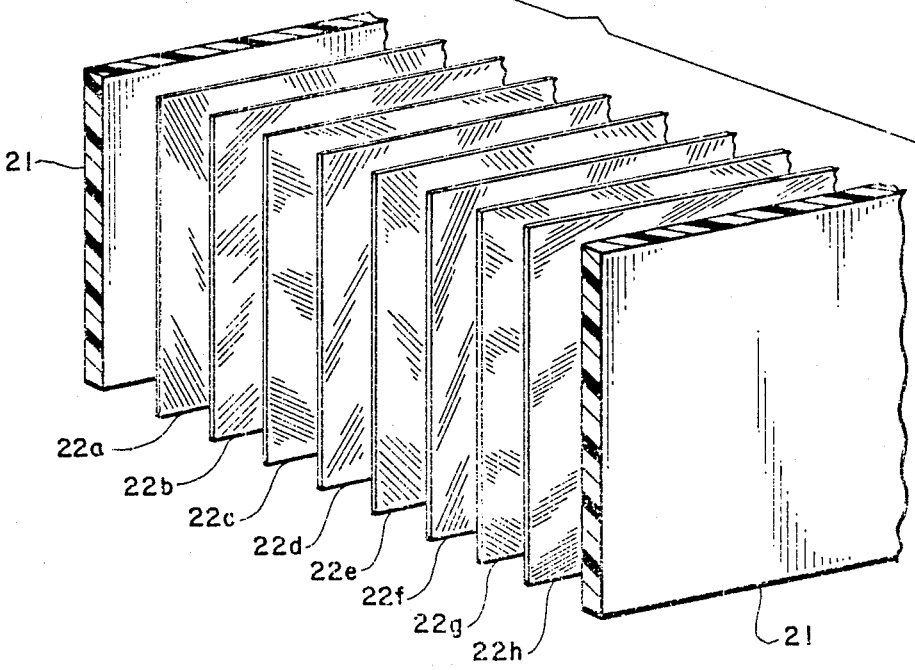
FIG. 2*b* is an exploded perspective view of the Kevlar TM laminate structure shown in FIG. 2*a* showing the cross-orientation of the Kevlar TM plies which make up the Kevlar TM sheet.
Figure 2A:
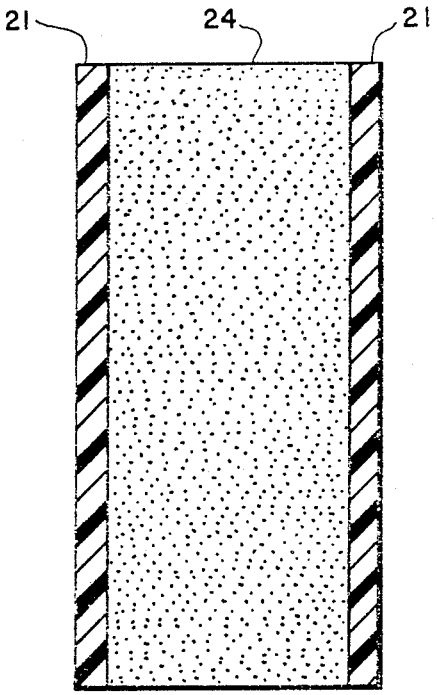
FIG. 2*a* is a cross-sectional view of a bidirectional laminate structure comprising a Kevlar TM sheet surrounded on each face with a layer of plastic.

FIG. 2*a* shows an embodiment comprising a center layer of Kevlar TM 24, surrounded on both sides by a single layer of a PMMA acrylic plastic 21, such as plexiglas TM . Card-gap tests have shown that PMMA plastics provide significant attenuation of shock waves, but that the attenuation is performed more efficiently in the initial depth of the plastic facing the explosive. By providing PMMA plastic faces to either side of a sheet made up of Kevlar TM plies, an attenuator more efficient than an equivalent thickness of either material used alone is formed. The total thickness of this laminate structure is about one inch, with the acrylic plastic layers each being approximately 0.125 inches thick, and the Kevlar TM layer approximately 0.75 inches thick.

FIG. 2*b* shows details of the construction of FIG. 2*a*, and a preferred orientation of the Kevlar TM filaments set at opposing angles from ply 22*a* to ply 22*h*. The number of plies may be more or less than as shown in the drawing.

Figure 2C:
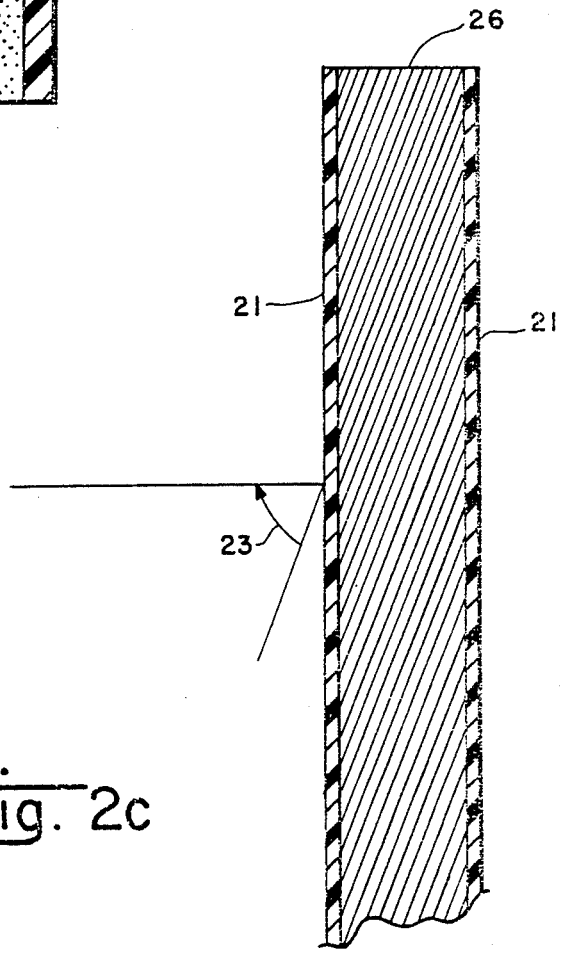
FIG. 2*c* is a cross-sectional view of the Kevlar TM laminate structure shown in FIG. 2*a* showing the Kevlar TM plies canted instead of parallel to the outer faces of the structure.

FIG. 2*c* shows a cross-sectional view of Kevlar TM plies 26 mounted in a canted postion at an angle 23 relative to the parallel faces of the plastic sheets 21. This canted positioning of the Kevlar TM plies serves to deflect projectiles away from their original direction and dissipates additional energy by requiring the projectiles to travel a greater distance through the material.

Figure 3C:
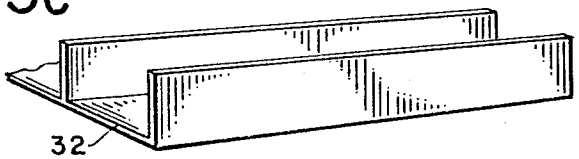
FIGS. 3*b* and 3*c* are perspective views of the rectangular troughs shown in FIG. 3*a*.
Figure 3B:
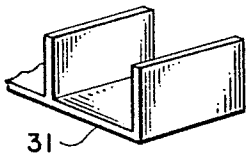
Figure 3A:
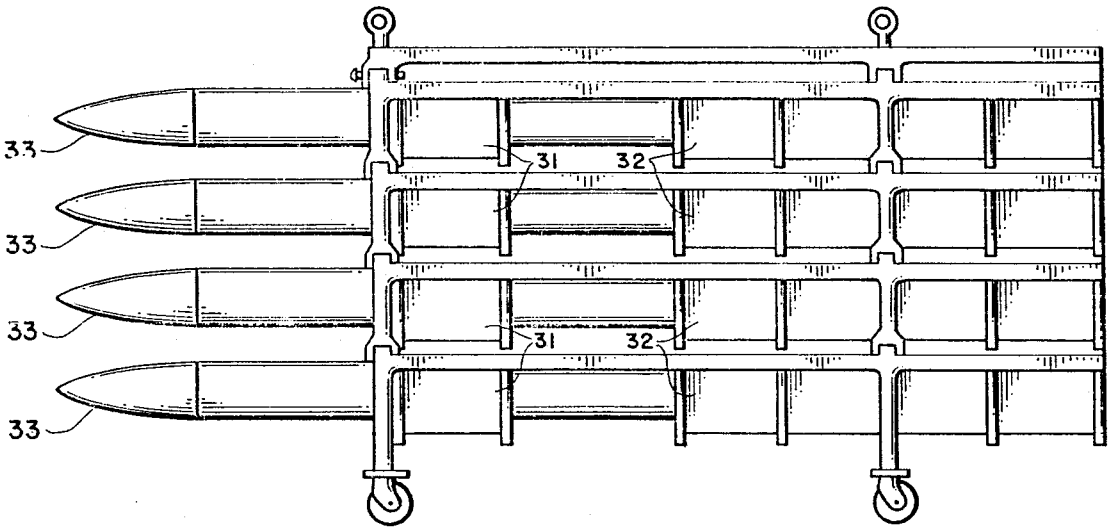
FIG. 3*a* is a side view of a missile rack utilizing protective rectangular troughs incorporating the present invention.

FIG. 3*a* shows a use for the laminate, formed into separate rectangular troughs 31 and 32 surrounding the warhead and rocket motor sections of each missile. The troughs are mounted in a four across missile rack, and the height of the side walls and the extension of the length of each trough beyond the length of the warhead or rocket motor is made sufficient so that no fragment from an accidentally exploded warhead or rocket motor can strike any other warhead or rocket motor on any other missile.

FIGS. 3*b* and 3*c* are perspective views of the trough sections 31 and 32 covering the warhead and rocket motor sections, respectively, of the missile container.

Figure 4:
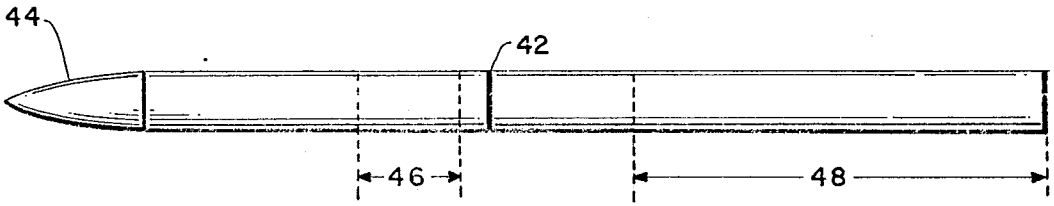
FIG. 4 is a cross-sectional view of a laminate according to the present invention placed in a missile between the rocket motor and warhead.

FIG. 4 shows a use for a laminate structure 42 placed inside a missile 44 between the warhead 46 and the rocket motor 48 sections of the missile 44. The laminate attenuates the explosive force of an accidental explosion of either the warhead 46 or the rocket motor 48 to prevent the sympathetic detonation of the other. Routine experimentation, along with the placement of other internal parts of the missile, will determine the exact placement of the laminate structure 42 inside the missile, or whether more than one laminate may be used.

It is understood that certain modifications to the invention as described may be made, as might occur to one with skill in the field of this invention, within the scope of the claims. Therefore, all embodiments contemplated have not been shown in complete detail. Other embodiments may be developed without departing from the spirit of the invention or from the scope of the appended claims.

We claim:

1. A missile transportation and storage rack for missiles having along their length sections enclosing, respectively, a rocket motor and a warhead, comprising:

(a) means for supporting a plurality of missiles in an array; and, (b) disposed inside the missile supporting means a plurality of laminated structures, each comprising a plurality of plane parallel plies of polyaramid filament sheets forming a layer having two opposite outer faces, the layer surrounded on both outer faces by sheets of plastic, whereby the laminated structures will block any fragment from any exploding rocket motor or warhead from striking any other rocket motor or warhead in any other missle.

2. A missile transportation and storage rack for missiles having along their length sections enclosing, respectively, a rocket motor and a warhead, comprising:

(a) means for supporting a plurality of missiles in an array;

(b) an explosive shock wave attenuation material comprising a plurality of plane parallel plies of polyaramid filament sheets forming a layer having two opposite outer faces, the layer surrounded on both outer faces by sheets of plastic, wherein the orientations of the filaments in each ply are in substantially the same direction; and, the orientations of the filaments in adjacent plies are in different directions;

(c) wall means defining rectangular troughs made of the explosive shock wave attenuating material;

(d) the troughs disposed in sections surrounding on three sides the explosive enclosing section of each missile; and, (e) each trough section being of sufficient length and height whereby the explosive attenuating material will block any fragment from any exploding rocket motor or warhead from striking any other rocket motor or warhead in any other missile.

3. The missile transportation and storage rack according to claim 2, wherein the plane parallel plies are canted relative to the sheets of plastic.

4. A missile transportation and storage rack for missiles having along their length sections enclosing, respectively, a rocket motor and a warhead, comprising:

(a) means for supporting a plurality of missiles in an array; and, (b) disposed inside the missile supporting means a plurality of laminated structures, each comprising a plurality of plane parallel plies of polyaramid filament sheets forming a layer having two opposite outer faces, the layer surrounded on both outer faces by sheets of plastic, wherein the thickness of each plastic sheet is generally less than one-fifth of the total thickness of the layer of polyaramid filament sheets; and, (c) whereby the laminated structures will block any fragment from any exploding rocket motor or warhead from striking any other rocket motor or warhead in any other missile.

5. A missile transportation and storage rack for missiles having along their length sections enclosing, respectively, a rocket motor and a warhead, comprising:

(a) means for supporting a plurality of missiles in an array;

(b) disposed inside the missile supporting means a plurality of laminated structures, each comprising a plurality of plane parallel plies of polyaramid filament sheets forming a layer having two opposite outer faces, the layer surrounded on both outer faces by sheets of plastic, whereby the laminated structures will block any fragment from any exploding rocket motor or warhead from striking any other rocket motor or warhead in any other missile; and, (c) wherein the orientations of the filaments in each ply are in substantially the same direction; and, the orientations of the filaments in adjacent plies are in different directions.

6. The missile transportation and storage rack according to claim 5, wherein the plane parallel plies are canted relative to the sheets of plastic.

* * * * *